US006336839B1

(12) United States Patent
Valli

(10) Patent No.: US 6,336,839 B1
(45) Date of Patent: Jan. 8, 2002

(54) MODULAR BRASSIERE FITMENT APPARATUS

(76) Inventor: Laila Valli, 701 King Street, Suite #706, Toronto, Ontario (CA), N5V 2W7

( * ) Notice: Subject to any disclaimer, the term of this patent is extended or adjusted under 35 U.S.C. 154(b) by 0 days.

(21) Appl. No.: 09/785,405

(22) Filed: Feb. 20, 2001

(51) Int. Cl.[7] ..... A41C 3/00
(52) U.S. Cl. ..... 450/1; 450/63; 450/25
(58) Field of Search ..... 450/1, 17, 18, 450/23, 25, 28, 63, 77, 79, 83, 84, 86, 88; 2/104, 114, 67, 80, 83; 73/149; 33/2 R, 14–16, 262, 511, 512

(56) References Cited

U.S. PATENT DOCUMENTS

| | | | | | |
|---|---|---|---|---|---|
| 2,180,180 | A | * | 11/1939 | Versoy | 450/85 |
| 2,559,501 | A | * | 7/1951 | Graf | 33/2 R |
| 2,946,125 | A | * | 7/1960 | Grittleson | 33/2 R |
| 3,311,112 | A | * | 3/1967 | Murray | 450/86 |
| 4,955,846 | A | * | 9/1990 | Greenberg | 450/1 |
| 4,957,466 | A | * | 9/1990 | Hopps | 450/85 |
| 5,414,943 | A | * | 5/1995 | Vogt | 33/764 |
| 5,965,809 | A | * | 10/1999 | Pechter | 73/149 |

* cited by examiner

*Primary Examiner*—Gloria M. Hale
(74) *Attorney, Agent, or Firm*—Marks & Clerk

(57) ABSTRACT

A modular brassiere fitment apparatus may be provided for use in the determination of the brassiere size of a woman. The modular brassiere fitment apparatus has the same general appearance as an ordinary brassiere except that it is based on a modular system. The first module comprises a pair of breast cups, a connecting front panel, and two side panels. The second module comprises a back panel. A third module may comprise a pair of shoulder straps. At least two first modules and at least two second modules make up a modular brassiere sizing kit where each of the first modules has a different size and each of the second modules has a different size, one from the other. When one of the first modules is assembled to one of the second modules from the modular brassiere sizing kit, the combination of the first and second modules constitutes a modular brassiere fitment apparatus. With the use of the modular brassiere sizing kit, the woman is able to mix and match different first modules and different second modules until she finds a combination that gives her a correct fit. Once the correct size of each of the first and second modules has been determined, the woman may easily purchase brassieres which will be comfortable and fit properly. When sizing, the first module will give a measurement of the woman's bust while the second module will give a measurement of her midriff. On combining the two sizes, the woman then determines her brassiere size.

25 Claims, 6 Drawing Sheets

MODULAR BRASSIERE FITMENT APPARATUS

FIELD OF THE INVENTION

This invention relates to a brassiere fitment apparatus, and particularly relates to a modular brassiere fitment apparatus for determining the correct brassiere size of a woman. The modular brassiere fitment apparatus of the present invention has the same general appearance as an ordinary brassiere, except that the brassiere fitment apparatus is based on modules which may be combined in sizes to precisely fit each breast of the woman and to provide natural support.

BACKGROUND OF THE INVENTION

The use of bust measuring devices has, of course, been known for many years. Their purpose is to provide accurate measurements of the bust such that the proper brassiere size may be determined for a woman.

Since brassieres are intimate apparel, many women are reluctant to seek assistance from lingerie fitting consultants when it comes to selecting such items. Most women simply choose several brassieres of various sizes and styles off the shelves in a store to try on, hoping to find one that would fit. On many occasions, the brassiere size stated on the label of the brassiere is disregarded by the woman.

It has been reported in a recent study that 65 to 70% of women wear a brassiere that does not fit correctly. Improper fitment of the brassiere renders the wearing of such a brassiere uncomfortable and may cause medical problems. Sagging breasts, or even more severely, poor back posture may result for these women.

A number of bust measuring devices are available to aid women in determining the correct brassiere size. They are usually in the form of a flexible tape measure. Unfortunately, these bust measuring devices are difficult to employ and often times, provide inaccurate measurements. In many instances, the assistance of a lingerie fitting consultant is required during the measuring process which may put the woman at unease. Thus, there is a need for a simple yet easy means to measure a woman's brassiere size correctly and accurately.

Quite surprisingly, the present inventor herein has determined that a modular brassiere fitment apparatus will easily allow for accurate determination of the brassiere size of a woman. By using the modular brassiere fitment apparatus of the present invention, the woman does not require a second person's assistance during the sizing process.

The present invention details a brassiere sizing kit which comprises numerous different first and second modules. The first module comprises a pair of breast cups, a connecting front panel and two side panels while the second module comprises a back panel. When one of the first modules is assembled to one of the second modules, the combination of the first and second module constitutes a modular brassiere fitment apparatus. In order to permit the woman who is trying on the modular brassiere fitment apparatus easy identification of each of the first and second modules within the brassiere sizing kit, markings have been placed on each module or they may be of different colors.

With the use of the modular brassiere sizing kit, the woman is able to mix and match different first modules and different second modules until she finds a combination that gives her a correct fit. Once the correct size of each of the first and second modules has been determined, the woman may easily purchase brassieres which will be comfortable and fit properly. When sizing, the first module will give a measurement of the woman's bust while the second module will give a measurement of her midriff. On combining the two sizes, the woman then determines her brassiere size.

The modular brassiere fitment apparatus of the present invention has a myriad of potential uses. A woman, in the privacy of her own home or in a fitting room at a store, can establish her bust size and her midriff size by trying out various combinations of first and second modules of the brassiere fitment apparatus and thus, determine her brassiere size. The present invention will save her the trouble of spending hours in a store's fitting room, trying to find a properly fitting brassiere. Since most stores have a 'no returns' policy for undergarments, it is important that the woman buys the correct brassiere at the initial purchase. Thus, the use of the modular brassiere fitting apparatus will help prevent the woman from purchasing a brassiere that she may later find to be incorrect in size. Moreover, use of the modular brassiere fitment apparatus of the present invention precludes the necessity of using fresh merchandise from the vendor's shelves in which merchandise might subsequently have to be sold to another customer even though it had been temporarily worn by other(s) previously.

From the lingerie retailers' perspective, the modular brassiere fitment apparatus allows them to properly size each customer. By having various modular brassiere sizing kits available in the store, the retailers allow their customers to mix and match different sizes modules in order to accommodate their specific needs. The kits allow their customers to determine their brassiere size without opening a multitude of packages of different brassieres, which in turn, allows better hygiene. Furthermore, having determined their brassiere size accurately, the chances that the retailers may have an unhappy customer with an ill-fitting brassiere is effectively precluded.

Although brassieres made by different manufacturers may vary in sizes, shapes and styles, the modular brassiere fitment apparatus provides a consistent basis for determining brassiere size of the woman for any manufacturer's products.

It is known that a woman's brassiere size changes several times in her lifetime, sometimes quite dramatically. Such changes may be the result of changes in body types, through pregnancy, for example. The present invention allows her to re-measure her brassiere size and therefore allows her to be as comfortable as she was before. Most importantly, by using such a modular brassiere fitment apparatus of the present invention, a woman gets to know her own brassiere size and finds a brassiere that fits her well. In fact, a woman's brassiere has often been compared with shoes, not only for the intricacy of its construction but mainly for the importance of its fit and comfort. Shoes, however, are easier to size than a brassiere. With this present invention, brassiere sizing is made easier.

The present invention allows women to establish their brassiere size and to continue to find a comfortable brassiere when their body type changes. Furthermore, it allows women to have a perfectly fitted modular brassiere fitment apparatus such that they may have a basis to follow when purchasing brassieres of any labels.

DESCRIPTION OF THE PRIOR ART

Several typical prior art bust measuring devices are now described. Some of them are in the adaptation of a measuring tape, or the like. They include GRAF U.S. Pat. No. 2,559,501, issued Jul. 3, 1951, which teaches a device that is essentially donned in the manner of a brassiere, there being graduated indicia provided on transparent cups and on the strap encircling the torso for measuring breast size and midriff. There is an adjustable buckle connecting the two breast cups such that a satisfactory separation of the breasts may be accomplished. The purpose of the invention is to provide an uncomplicated, inexpensive sanitary bust measuring device. However, the device is not at all simple to use. In order to obtain both breast and midriff measurements, the device must be manipulated in at least six operational steps. Furthermore, the assistance of another person is required when using such a device.

Another bust measuring device which is in the adaptation of a measuring tape is shown in GITTELSON U.S. Pat. No. 2,946,125, issued Jul. 26, 1960. The bust measuring device disclosed in that patent is a harness-type apparatus with an adjustable horizontal measuring tape or strip and a pair of vertically disposed measuring tapes or strips which pass through slits located at spaced points in the horizontal strip.

A brassiere measuring tape is disclosed in HAYES U.S. Pat. No. 3,292,261, issued Dec. 20, 1966. Here, a tape with graduated indicia thereon is held encircling the torso of the wearer while a separate tape is attached thereto such that markings indicative of breast cups sizes may be seen. The tape is then placed around the torso once again, encircling the breasts this time, such that one marking indicative of breast cup size is combined with the previously determined torso girth.

In U.S. Pat. No. 3,763,865 issued Oct. 9, 1973 to DEFRU, the inventor has provided a brassiere that may be employed as a conventional brassiere or as merely an uplifting device. There is a portion of each bra cup that is foldable such that the breast is uncovered yet still uplifted by a cradle strap located below each breast.

In another U.S. Pat. No. 4,144,912 issued Mar. 20, 1979, the inventor PUNDYK has provided a brassiere having a pair of breast pockets where each pocket comprises three sections: a front panel, a second elastomeric panel, and an inner panel. This brassiere allows for full and independent adjustment of each breast cup without having to make any strap adjustments.

U.S. Pat. No. 4,416,284 issued Nov. 22, 1983 to FINK teaches two, three-cornered breast cups and supporting straps, where the cups are made for a variety of shapes and sizes for use in single piece or in any combination therewith. The supporting straps are attached to each of the three cup comers such that two straps are adapted to pass horizontally around the chest of the wearer and third strap is extended up and over an adjacent shoulder.

U.S. Pat. No. 4,955,846 issued Sept. 11, 1990 to GREENBERG teaches a brassiere having a separable fastener which includes first and second linear elements. These elements allow the brassiere to be gathered along the vertical center line of the brassiere. This has the effect of pulling down on the center line of the brassiere to create a plunging neckline, which in turn reduces the size of the breast cups in both the horizontal and vertical direction.

VOGT U.S. Pat. No. 5,414,943 issued May 16, 1995 teaches an anatomical measuring device which comprises two measuring tapes. The first tape measures the rib cage girth and the second tape measures cup size. The housing of the tapes has windows such that measurement from each tape may be exposed.

U.S. Pat. No. 5,619,804 issued Apr. 15, 1997 to VOGT is a continuation-in-part to the previously described U.S. Pat. No. 5,414,943. Here, a single tape is used for the determination of both the rib cage girth and the cup size. Furthermore, electronic circuitry is used to translate the measurements into nominal sizes.

Finally, PECHTER U.S. Pat. No. 5,965,809 issued Oct. 12, 1999 teaches a method of direct breast measurement by using a device which comprises a flexible tape. The torso size is first determined, then with the use of the same tape, the circumference of the unclothed breast from the beginning of the breast mound at one side laterally to the parastemal area medially is measured. After such measurements are taken, a measurement conversion is applied and a cup size is determined.

SUMMARY OF THE INVENTION

In accordance with one aspect of the present invention, there is provided a modular brassiere fitment apparatus. The modular brassiere fitment apparatus of the present invention comprises a pair of breast cups, a connecting front panel, two side panels, and a back panel. The pair of breast cups, the connecting front panel, the two side panels and the back panel together are being arranged so as to encircle the region of the midriff of the woman when the modular brassiere fitment apparatus is in use.

The pair of breast cups, the connecting front panel and the two side panels comprise a first module while the back panel comprises a second module.

Each of the breast cups has front, bottom and side edges. The front edge of each of the breast cups is connected to the connecting front panel such that each of the breast cups is adapted so as to be horizontally aligned below the respective breast for fitment thereto when the modular brassiere fitment apparatus is in use.

Each of the side panels has first and second ends. The first end of each of the side panels is attached to the side edge of each of the respective breast cups such that each of the side panels is formed as a lateral extension of each of the respective breast cups. The second end of each of the side panels comprises fastening means for fitment of the modular brassiere fitment apparatus to the midriff of a woman.

The back panel is symmetrical in structure and comprises first and second half back panels which are contiguous one with the other. The first half back panel has a first end and the second half back panel has a second end.

The first and second ends of the back panel include fastening means so as to fasten the first and second ends of the back panel to the respective second end of each of the side panels. When the modular brassiere fitment apparatus is in use, the back panel and the two side panels are horizontally aligned and each fastening point is adapted so as to be vertically aligned below the shoulder blade of the woman.

The back panel further comprises graduated indicia in at least one of the first and second ends of the respective first and second half back panels in the region of the fastening means so as to permit the midriff of the woman to be measured when the modular brassiere fitment apparatus is in use.

Each of the breast cups has defined shape and dimensions so as to receive and accommodate the respective breast of the woman. Each of the breast cups is chosen from the group of breast cups consisting of a plurality of incremental breast cup sizes, within a predetermined range, so as to permit the breast of the woman to be fitted when the modular brassiere fitment apparatus is in use.

Each of the breast cups is chosen from the group consisting of molded cups, sewn cups and padded cups.

In keeping with the present invention, each of the breast cups further comprises indicia such that the size of each of the breast cups may be identified.

Moreover, each pair of breast cups may be chosen from the group consisting of two breast cups of equal size, two breast cups of unequal size, and one breast cup and one prosthesis.

The second end of each of the side panels is fastened to the respective first and second ends of the back panel by a two-part fastener which may be chosen from the group of two-part fasteners consisting of hook and eyelet fasteners, hook and loop fasteners, and snap and dome fasteners.

The two-part fastener has first and second elements so as to fasten the second end of each of the side panels to the respective first and second ends of the back panel. The first element of the two-part fastener is situated at the second end of each of the side panels and the first element of the two-part fastener comprises a single row of fastener means in vertical alignment. The second element of the two-part fastener is situated at each of the first and second ends of the back panel and the second element of the two-part fastener comprises a plurality of fastening means in vertical alignment.

When the second end of each of the side panels is fastened to the respective first and second ends of the back panel, the second end of each of the side panels overlies a substantial portion of the respective first and second ends of the back panel.

Typically, but not necessary, the modular brassiere fitment apparatus which is described above may further comprise a pair of shoulder straps. The pair of shoulder straps comprises a third module.

Each of the shoulder straps may further comprise an adjustable buckle so as to permit longitudinal adjustment of each of the shoulder straps.

When the modular brassiere fitment apparatus is in use, each of the shoulder straps connects between a respective one of the breast cups and a respective one of the half back panels such that each of the shoulder straps extends upwardly over the shoulder of the woman and downwardly over the back of the woman.

In a particular embodiment of the present invention, each of the shoulder straps is permanently affixed to a respective one of the breast cups. In such an embodiment, the connection between each of the shoulder straps and one of the breast cups comprises a hoop and loop structure.

In another embodiment of the present invention, each of the shoulder straps is permanently affixed to one of the half back panels. In such an embodiment, the connection between each of the shoulder straps and one of the half back panels comprises a hoop and loop structure.

Typically, the connecting front panel, the two side panels, the back panel and the pair of shoulder straps are all formed from pliant materials so as to provide comfort to the woman of the modular brassiere fitment apparatus.

Typically, but not necessary, each of the breast cups may further comprise an underwire at the bottom edge of each of the breast cups such that uplift support to each breast of the woman is provided when the modular brassiere fitment apparatus is in use.

In keeping with another aspect of the present invention, there is provided a modular brassiere sizing kit which comprises at least two first modules and at least two second modules. Each of the at least two first modules comprises a pair of breast cups, a connecting front panel and two side panels and each of the at least two second modules comprises a back panel. Furthermore, each of the first modules has a different size, one from the other, and each of the second modules has a different size, one from the other. When one of the at least two first modules is assembled to one of the at least two second modules, the combination of the first and second module constitutes a modular brassiere fitment apparatus which is described above.

In order to permit identification of the size of each respective one of the at least two first modules, each of the at least two first modules of the modular brassiere fitment apparatus further comprises indicia. Each pair of breast cups of the modular brassiere fitment apparatus has a mutually distinctive color, one from the other.

In order to permit identification of the size of each respective one of the at least two second modules, each of the at least two second modules of the modular brassiere fitment apparatus further comprises indicia.

Typically, but not necessarily, the modular brassiere sizing kit may further comprise at least one pair of shoulder straps, and that pair of shoulder straps comprises a third module of the modular brassiere fitment apparatus.

Another object of the present invention is to provide a method of determining the brassiere size of any woman using a modular brassiere sizing kit which comprises at least two first modules and at least two second modules. Each of the at least two first modules comprises a pair of breast cups, a connecting front panel and two side panels and each of the at least two second modules comprises a back panel. Moreover, each of the first modules has a different size, one from the other, and each of the second modules has a different size, one from the other. When one of the at least two first modules is assembled to one of the at least two second modules, the combination of the first and second modules constitutes a modular brassiere fitment apparatus. The method comprises the steps of:

(a) selecting one of the at least two first modules of an apparent appropriate size from the modular brassiere sizing kit.

(b) selecting one of the at least two second modules of an apparent appropriate size from the modular brassiere sizing kit.

(c) fastening a second end of one of the side panels of the first module to a respective end of the back panel of the second module.

(d) fitting the modular brassiere fitment apparatus to the woman.

(e) completing the assembly of the modular brassiere fitment apparatus by fastening the second end of the other side panel of the first module to the respective end of the back panel of the second module.

(f) adjusting the modular brassiere fitment apparatus such that the modular brassiere fitment apparatus encircles the region of the midriff of the woman.

(g) adjusting the modular brassiere fitment apparatus such that each of the breast cups of the first module is horizontally aligned below the respective breast of the woman for fitment thereto.

When at least one of the first and second modules of the modular brassiere fitment apparatus is incorrect in size, steps (a) through (g) are repeated.

These and other objects of the present invention are discussed in greater detail hereafter, in association with the accompanying drawings.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS:

The novel features which are believed to be characteristic of the present invention, as to its structure, organization, use and method of operation, together with further objectives and advantages thereof, will be better understood from the following discussion.

As noted above, a feature of the present invention is essentially to provide a modular brassiere fitment apparatus for determining the correct brassiere size of a woman. The modular brassiere fitment apparatus of the present invention has the same general appearance as an ordinary brassiere, except that the brassiere fitment apparatus is based on modules which may be combined in sizes to precisely fit each breast of the woman and to provide natural support.

Figure 1:
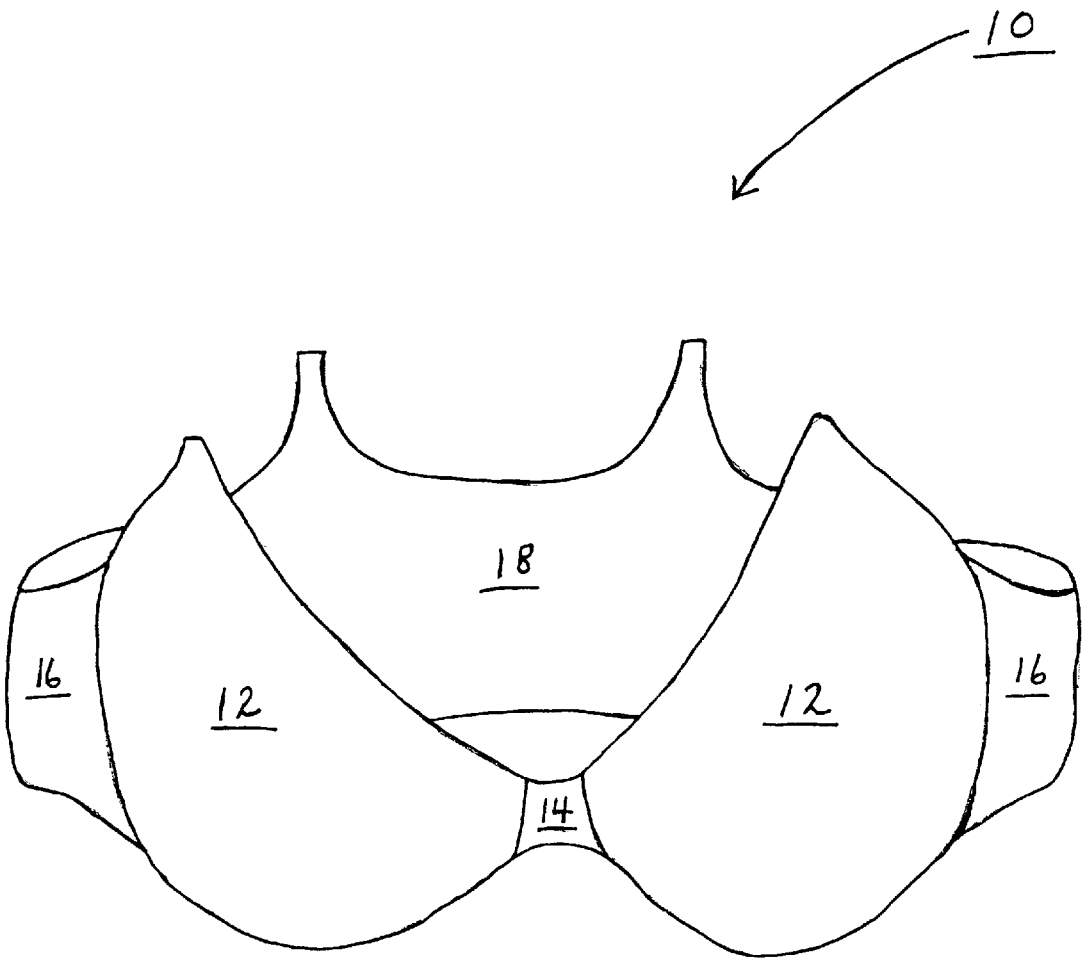
FIG. 1 is a front view of the modular brassiere fitment apparatus in keeping with the present invention.
Figure 2:
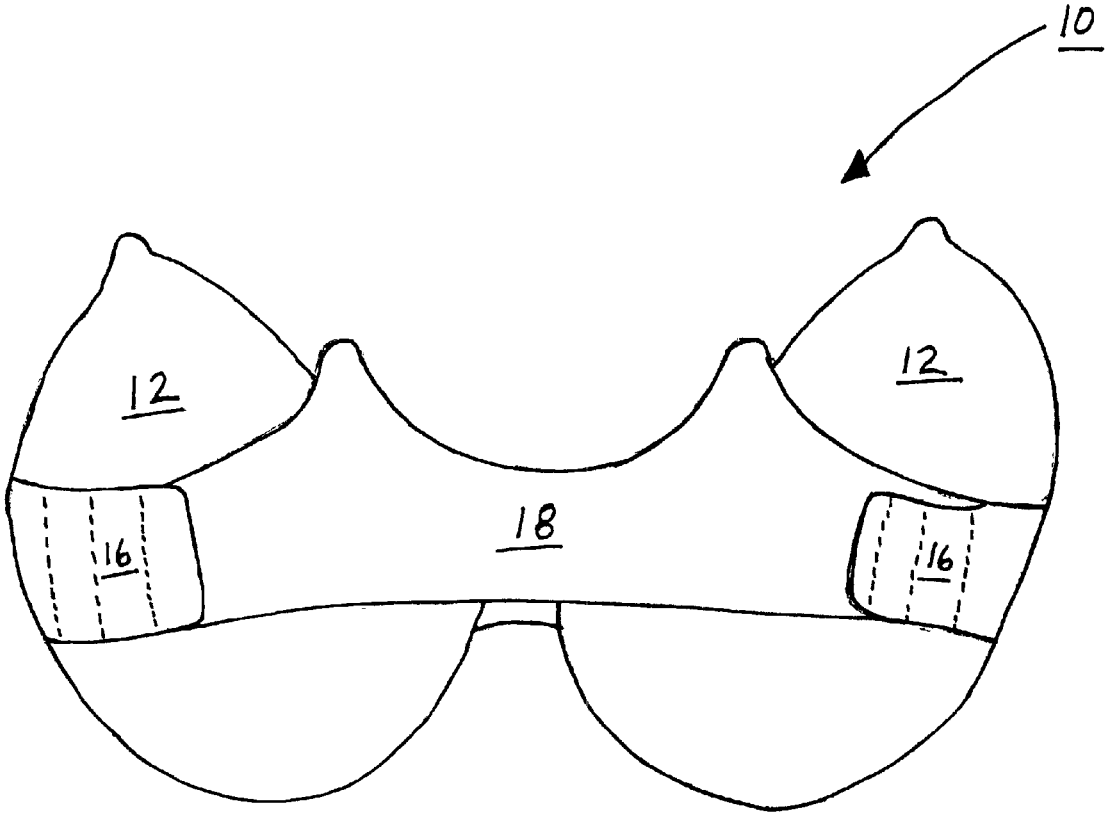
FIG. 2 is a rear view of the modular brassiere fitment apparatus in keeping with the present invention.

Turning first to FIGS. 1 and 2, a front view and a rear view of the modular brassiere fitment apparatus 10 are shown respectively. The modular brassiere fitment apparatus 10 comprises a pair of breast cups 12, a connecting front panel 14, two side panels 16, and a back panel 18. The pair of breast cups 12, the connecting front panel 14, the two side panels 16 and the back panel 18 together are being arranged so as to encircle the region of the midriff of the woman when the modular brassiere fitment apparatus 10 is in use (best seen in FIGS. 3 and 4).

Figure 5:
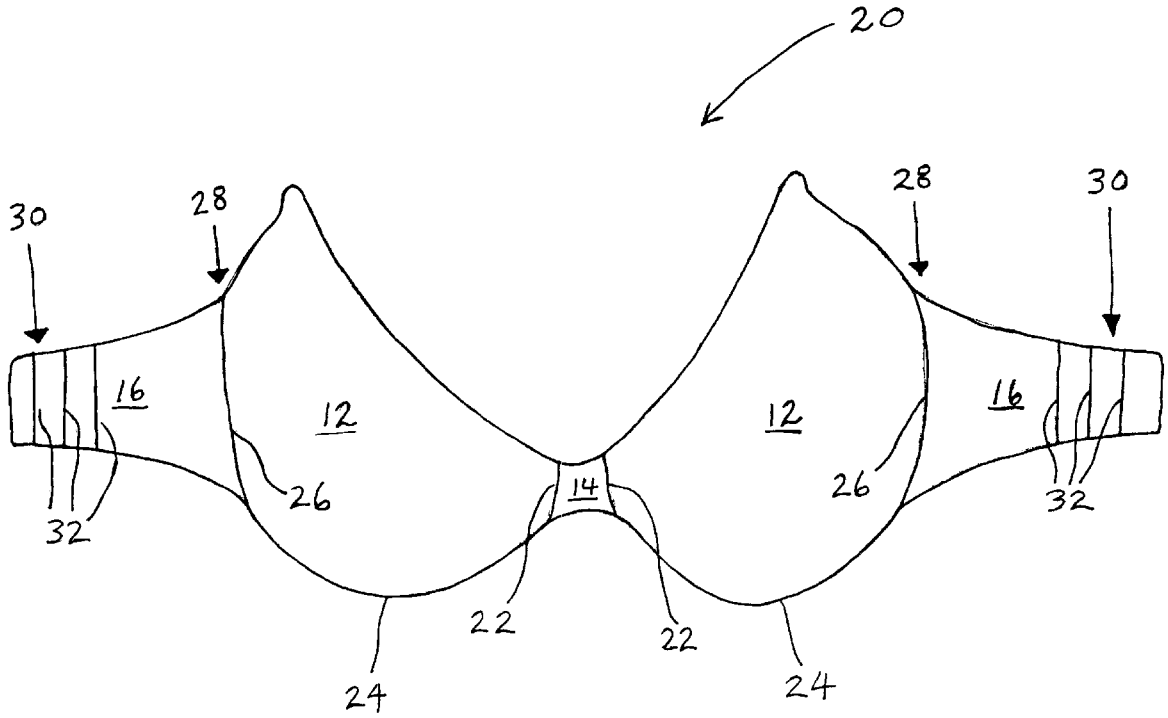
FIG. 5 is a front view of the first module of the modular brassiere fitment apparatus in keeping with the present invention.

With reference to FIG. 5, the pair of breast cups 12, the connecting front panel 14 and the two side panels 16 comprise a first module 20. Each of the breast cups 12 has front, bottom and side edges, designated by reference numerals 22, 24, and 26 respectively. The front edge 22 of each of the breast cups 12 is connected to the connecting front panel 14 such that each of the breasts cups 12 is adapted so as to be horizontally aligned below the respective breast for fitment thereto when the modular brassiere fitment apparatus 10 is in use.

Each of the side panels 16 has first and second ends, 28 and 30 respectively. The first end 28 of each of the side panels 16 is attached to the side edge 26 of each of the respective breast cups 12 such that each of the side panels 16 is formed as a lateral extension of each of the respective breast cups 12. In order to permit fitment of the modular brassiere fitment apparatus 10 to the midriff of the woman, the second end 30 of each of the side panels 16 comprises fastening means 32.

Figure 6:
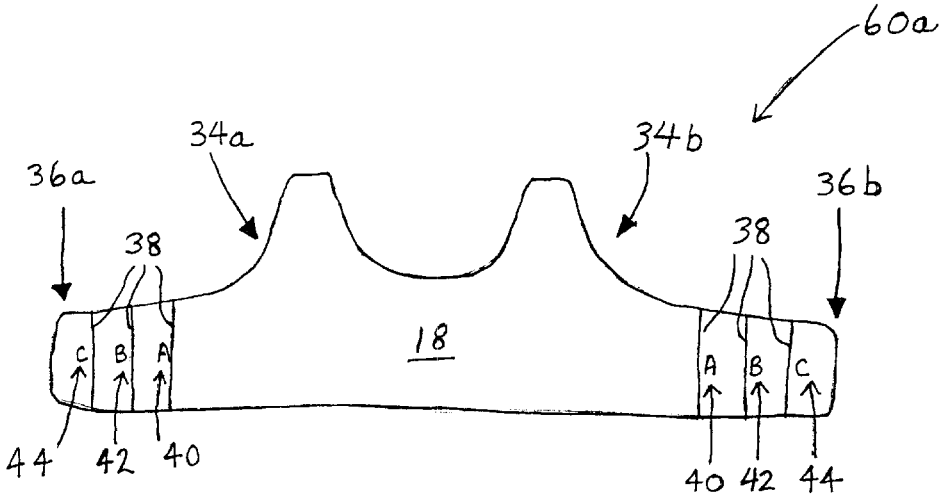
FIG. 6 is a front view of the second module of a first embodiment of the modular brassiere fitment apparatus in keeping with the present invention.
Figure 7:
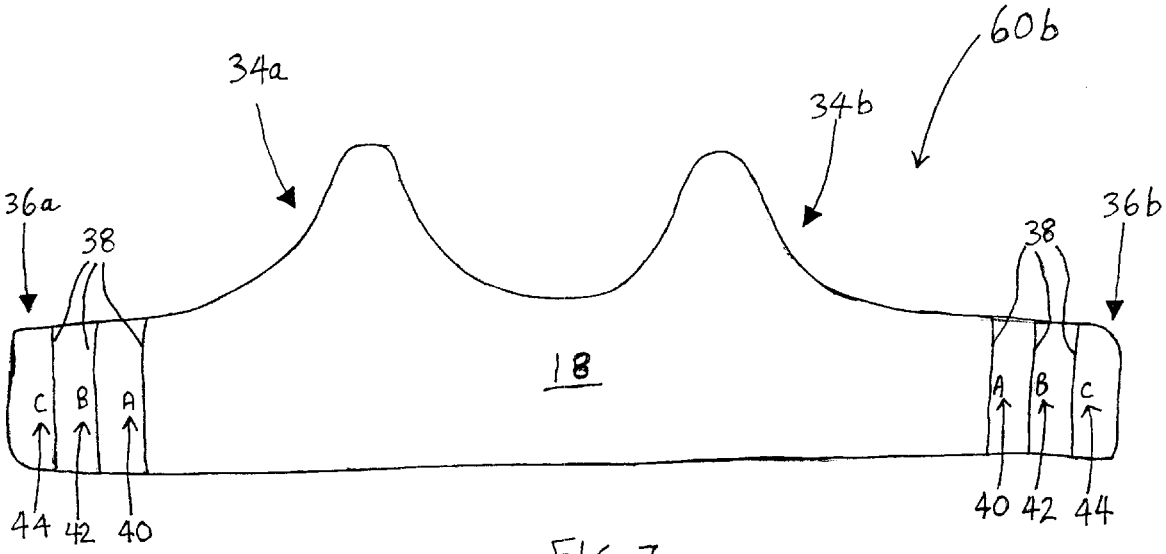
FIG. 7 is a front view of the second module of a second embodiment of the modular brassiere fitment apparatus in keeping with the present invention.

The second module 60 of the modular brassiere fitment apparatus 10 is shown in FIGS. 6 and 7. The second module 60*a* shown in FIG. 6 is considerably smaller in size when compared to the second module 60*b* shown in FIG. 7. As can be seen in both Figures, the back panel 18 is symmetrical in structure and comprises first and second half back panels, designated by reference numerals 34*a* and 34*b* respectively, which are contiguous one with the other. The first half back panel 34*a* has a first end 36a while the second half back panel 34*b* has a second end 36*b*.

The first and second ends 36*a* and 36*b* respectively of the back panel 18 include fastening means 38 so as to fasten the first and second ends 36*a* and 36*b* respectively of the back panel 18 to the respective second end 30 of each of the side panels 16. When the modular brassiere fitment apparatus 10 is in use, the back panel 18 and the two side panels 16 are horizontally aligned and each fastening point is adapted so as to be vertically aligned below the shoulder blade of the woman (best seen in FIG. 2).

As noted in FIGS. 6 and 7, the back panel 18 further comprises graduated indicia, designated by reference numerals 40, 42, and 44 in at least one of the first end 36*a* and second end 36*b* of the respective first and second halfback panels 34*a* and 34*b* respectively in the region of the fastening means 38 so as to permit the midriff of the woman to be measured when the modular brassiere fitment apparatus 10 is in use. Turning first to FIG. 6, indicia 40 denotes a midriff measurement of thirty-two inches, for example, while indicia 42 denotes a midriff measurement of thirty-four inches and indicia 44 denotes a midriff measurement of thirty-six inches. However, with reference to FIG. 7, indicia 40 denotes a midriff measurement of thirty-eight inches, while indicia 42 denotes a midriff measurement of forty inches and indicia 44 denotes a midriff measurement of forty-two inches.

Each of the breast cups 12 of the modular brassiere fitment apparatus 10 has defined shape and dimensions so as to receive and accommodate the respective breast of the woman. Each of the breast cups 12 is chosen from the group of breasts cups consisting of a plurality of incremental breast cup sizes, within a predetermined range, so as to permit the breast of the woman to be fitted when the modular brassiere fitment apparatus 10 is in use.

Furthermore, each of the breast cups 12 may be chosen from the group consisting of molded cups, sewn cups and padded cups. Depending upon the type of fashion the woman is intended to wear, she may desire to wear one type of breast cups 12 over another in order to achieve a certain appearance with such a modular brassiere fitment apparatus 10.

Still further, each of the breast cups 12 comprises indicia such that the size of each of the breast cups 12 may be identified.

Since each breast cups 12 of the modular brassiere fitment apparatus 10 may be connected individually to the connecting front panel 14, each pair of breast cups 12 of the modular brassiere fitment apparatus 10 may be chosen from the group consisting of two breast cups 12 of equal size, two breast cups 12 of unequal size, and one breast cup 12 and one prosthesis. The modular structure of this apparatus thus allowed women with breasts of equal or unequal sizes to find a brassiere which would fit them properly. It is not uncommon that women have breasts of different sizes. Indeed, women who have undergone a masectomy may establish their brassiere size by using such a modular brassiere fitment apparatus 10 by substituting a prosthesis for one of the breast cups.

In accordance with the present invention, the modular brassiere fitment apparatus 10 comprises a plurality of two-part fasteners. The two-part fastener may be an hook and eyelet fastener. Other two-part fasteners which may be used are hook and loop fastener and snap and dome fastener.

For assembling of the modular brassiere fitment apparatus 10 to the body of the woman, the second end 30 of each of the side panels 16 is fastened to the respective first and second ends 36*a* and 36*b* of the back panel 18 by such two-part fasteners. The two part fastener has first and second elements 32 and 38 respectively. The first element 32 of the two-part fastener is situated at the inner surface of the second end 30 of each of the side panels 16, and furthermore, the first element 32 are arranged vertically in a single row. The second element 38 of the two-part fastener, on the other hand, is situated at the outer surface of each of the first and second ends 36*a* and 36*b* of the back panel 18 and the second element 38 are aligned vertically in a plurality of rows. The arrangement is such that the first element 32 is adapted to receive the second element 38 of the two-part fastener.

Figure 4:
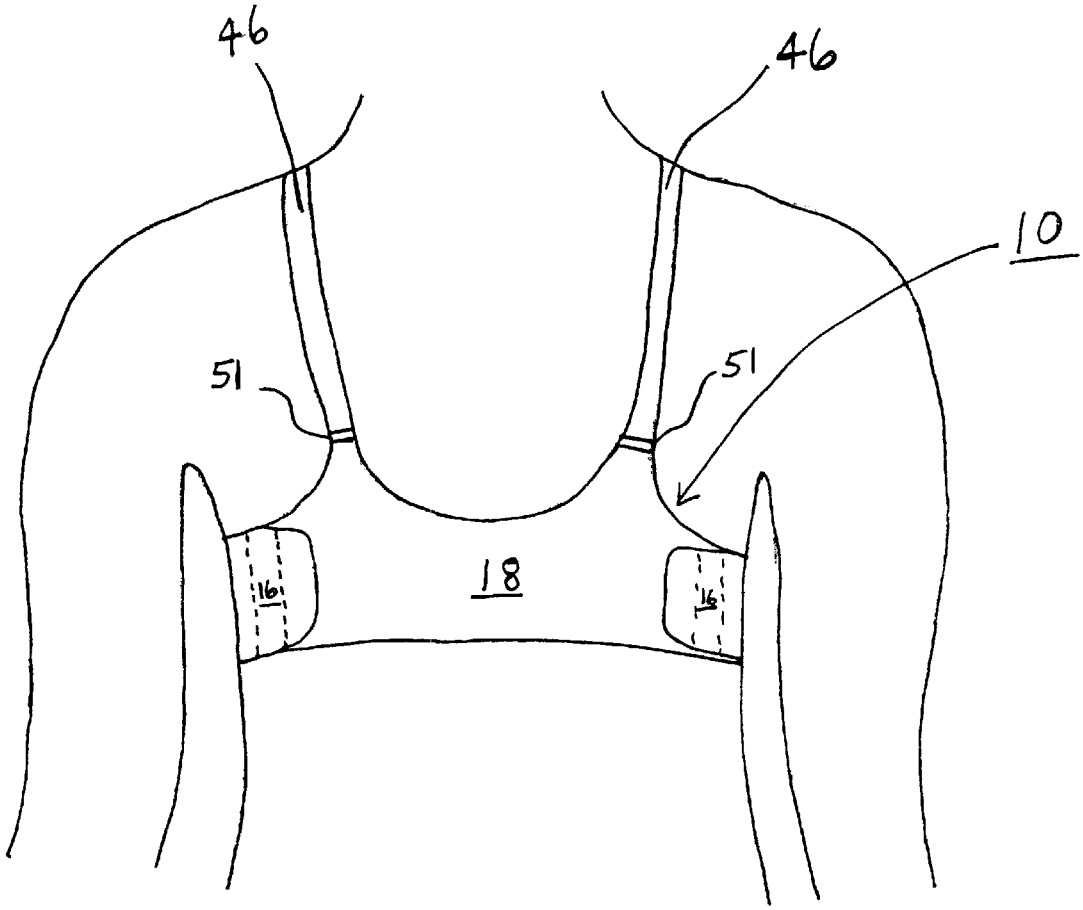
FIG. 4 is a rear view of the modular brassiere fitment apparatus in keeping with the present invention when in use.

When the second end 30 of each of the side panels 16 is fastened to the respective first and second ends 36*a* and 36*b* of the back panel 18, the second end 30 of each of the side panels 16 overlies a substantial portion of the respective first and second ends 36*a* and 36*b* of the back panel 18 as can be seen particularly in FIG. 4.

Figure 3:
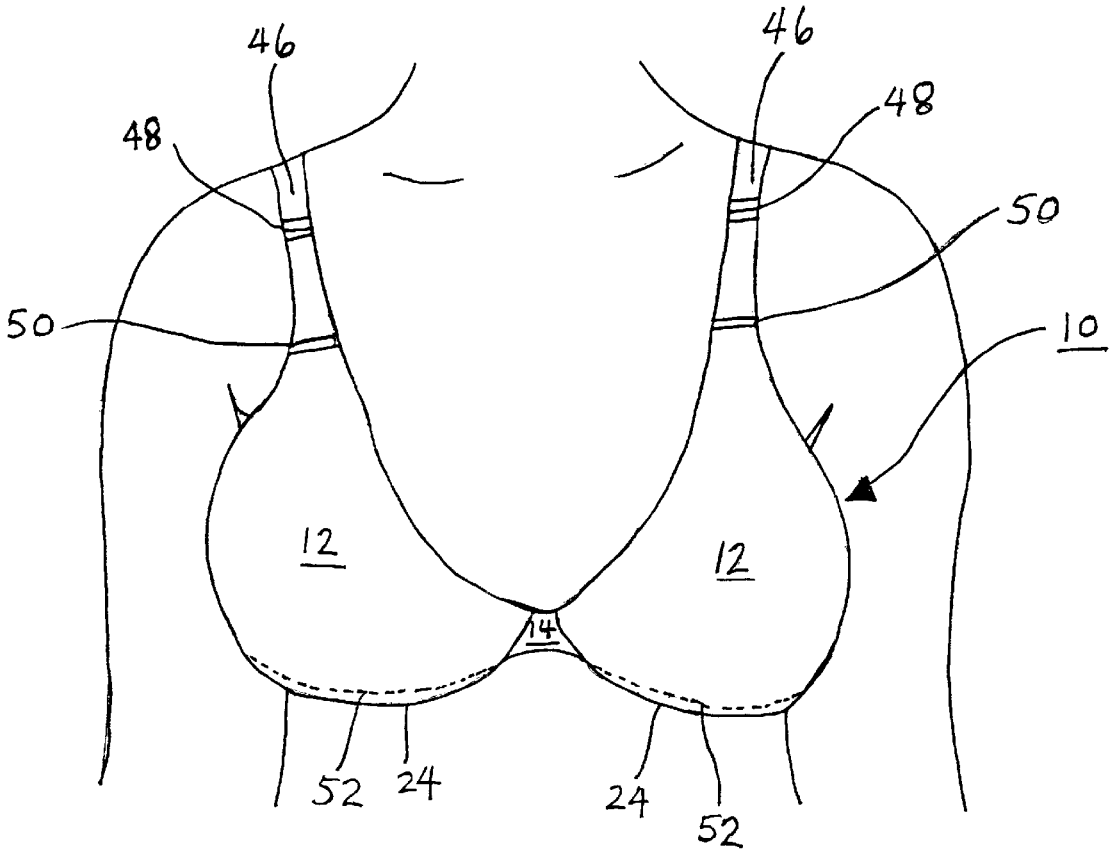
FIG. 3 is a front view of the modular brassiere fitment apparatus in keeping with the present invention when in use, supporting the breasts of the woman.

Typically, but not necessary, the modular brassiere fitment apparatus 10 may further comprise a pair of shoulder straps 46 (FIG. 3). The pair of shoulder straps 46 comprises a third module.

Each of the shoulder straps 46 may comprise an adjustable buckle 48 so as to permit longitudinal adjustment of each of the shoulder straps 46.

When the modular brassiere fitment apparatus 10 is in use, each of the shoulder straps 46 connects between a respective one of the breast cups 12 and a respective one of the half back panels 34*a* and 34*b* respectively such that each of the should straps 46 extends upwardly over the shoulder of the woman and downwardly over the back of the woman.

In a particular embodiment of the present invention (FIG. 3), each of the shoulder straps 46 is permanently affixed to a respective one of the breast cups 12. In such an embodiment, the connection between each of the shoulder straps 46 and one of the breast cups 12 comprises a hoop and loop structure 50.

In another embodiment of the present invention (FIG. 4), each of the shoulder straps 46 is permanently affixed to one of the half back panels 34. In such an embodiment, the connection between each of the shoulder straps 46 and one of the half back panels 34 comprises a hoop and loop structure 51.

With the inclusion of shoulder straps 46 as a third module of the modular brassiere fitment apparatus 10, the woman may wear the modular brassiere fitment apparatus 10 in numerous different styles. For instance, the woman may wear the modular brassiere fitment apparatus 10 in such a manner that each of shoulder straps 46 crisscrosses one another in the region of the shoulder blades of the woman. On another occasion, the woman may wear the modular brassiere fitment apparatus 10 as a halter brassiere where only one shoulder strap 46 is required.

The connecting front panel 14, the two side panels 16, the back panel 18 and the pair of shoulder straps 46 of the modular brasserie fitment apparatus 10 are generally formed from pliant materials so as to provide comfort to the woman wearing the modular brassiere fitment apparatus 10. Additionally, such pliant materials may have elastomeric properties. In the latter case, greater comfort is provided to the woman since the modular brassiere fitment apparatus 10 is stretchable and will conform to the specific body configuration of the woman. Still further, the modular brassiere fitment apparatus 10 may be constructed from a soft plastic material which may be clear such that the modular brassiere fitment apparatus 10 gives a "no bra" appearance but yet provides sufficient breast support to uplift the breasts of the woman. The pair of breast cups 12 of the modular brassiere fitment apparatus 10 may also be composed of dual layers of pliant materials such that the modular brassiere fitment apparatus 10 gives the breasts of the woman a larger and fuller appearance.

Typically, but not necessary, each of the breast cups 12 may further comprise an underwire 52 at the bottom edge 24 of each of the breast cups 12 such that uplift support to each breast of the woman is provided when the modular brassiere fitment apparatus 10 is in use, as can be particularly seen in FIG. 3.

In keeping with the provisions of the present invention, the inventor herein provides a modular brassiere sizing kit which comprises at least two first modules 20 and at least two second modules 60. Within each modular brassiere sizing kit, each of the first modules 20 has a different size, one from the other, and each of the second modules 60 has a different size, one from the other. When one of the at least first modules 20 is assembled to one of the at least second modules 60, the combination of the first and second modules, 20 and 60 respectively, constitutes the modular brassiere fitment apparatus 10 which is described above.

Furthermore, the modular brassiere sizing kit may comprise at least one pair of shoulder straps 46, and that pair of shoulder straps comprises a third module of the modular brassiere fitment apparatus 10. Each pair of shoulder straps 46 may have a mutually distinctive color, one from the other. However, each pair of shoulder straps 46 may also be clear such that a strapless brassiere appearance is given.

In order to be able to identify the size of each respective one of the at least two first modules 20, the at least two first modules 20 of the modular brassiere fitment apparatus 10 further comprises indicia. Each pair of breasts cups 12 of the modular brassiere fitment apparatus 10 may have a mutually distinctive color, one from the other. Ornamental objects may be sewn or attached onto the breast cups 12, the connecting front panel 14, the side panels 16 or the back panel 18 as well.

Similarly, each of the at least two second modules 60 of the modular brassiere fitment apparatus 10 comprises indicia such that the woman is able to identify the size of each respective one of the at least two second modules 60. Such indicia are found in the region of the fastening means 38 of the back panel 18 and they may be numerical increments in inches or in centimeters.

Various cup sizes and back panel sizes are shown below. For the sake of simplicity, the phrase "back panel" is used interchangeably with the phrase "band" in this discussion.

Turning first to Table 1, five groups of cups are shown and each group comprises three different cup sizes. For example, cup group I includes cups A, B, and C. In this Table, cup A is smallest in size while cup G is the largest. Thus, cup group I is designed for women with the smallest breasts while cup group V is designed for women with the largest breasts.

| CUP GROUPS | CUP SIZES |
|---|---|
| I | A/B/C |
| II | B/C/D |
| III | C/D/E |
| IV | D/DD/E |
| V | E/F/G |

Table 2 illustrates the various band sizes and the corresponding midriff measurements. Abbreviations S, M, L, and XL correspond to small, medium, large and extra-large respectively. According to Table 2, the smallest band size is designated by the letter S while the largest band size is referred to as 5XL. It is important to note that the band sizes displayed herein are in inches. The S band are designed for women with midriff measurement between 30 and 36 inches while the 5XL band are designed for women with midriff measurement which falls in the range of 58 to 64 inches.

| BAND SIZES | |
|---|---|
| S | 30/32, 34/36 |
| M | 34/36, 38/40 |
| L | 38/40, 42/44 |
| XL | 42/44, 46/48 |
| 2XL | 46/48, 50/52 |
| 3XL | 50/52, 54/56 |
| 4XL | 54/56, 58/60 |
| 5XL | 58/60, 62/64 |

For example, a particular brassiere sizing kit may comprise cup group I which contains three first modules with cup sizes A, B, and C and four second modules with band sizes in small, medium, large and extra-large. In another brassiere sizing kit, there may be three first modules with cup sizes E, F, and G (Cup Group V) and three second modules with band sizes in 3XL, 4XL and 5XL.

Generally, brassieres made by different manufacturers may vary in sizes. For example, a 32C brassiere made by manufactures in Asia may correspond to a 32A brassiere in North America. Furthermore, it has been found that a garment normally designated as brassiere size 3 8D can be worn by other women who would normally wear brassiere sizes 38C,36DD, and 36D. However, with the use of the modular brassiere sizing kit of the present invention, a woman is able to relate the size of any one module made by one manufacture to another of the same module made by another manufacturer and thus to establish her brassiere size.

In keeping with another aspect of the present invention, the inventor herein provides a method of determining the brassiere size of any woman using a modular brassiere sizing kit which comprises at least two first modules 20 and at least two second modules 60 where each of the first modules 20 has a different size, one from the other, and each of the second modules 60 has a different size, one from the other. When one of the at least two first modules 20 is assembled to one of the at least two second modules 60, the combination of the first and second modules constitutes a modular brassiere fitment apparatus 10. The method comprises the following steps:

(a) selecting one of the at least two first modules 20 of an apparent appropriate size from the modular brassiere sizing kit.

(b) selecting one of the at least two second modules 60 of an apparent appropriate size from the modular brassiere sizing kit.

(c) fastening a second end 30 of one of the side panels 16 of the first module 20 to a respective end 36 of the back panel 18 of the second module 60.

(d) fitting the modular brassiere fitment apparatus 10 to the woman.

(e) completing the assembly of the modular brassiere fitment apparatus 10 by fastening the second end 30 of the other side panel 16 of the first module 20 to the respective end 36 of the back panel 18 of the second module 20.

(f) adjusting the modular brassiere fitment apparatus 10 such that the modular brassiere fitment apparatus 10 encircles the region of the midriff of the woman.

(g) adjusting the modular brassiere fitment apparatus 10 such that each of the breast cups 12 of the first module 20 is horizontally aligned below the respective breast of the woman for fitment thereto.

When at least one of the first and second modules 20 and 60 respectively of the modular brassiere fitment apparatus 10 is incorrect in size, steps (a) through (g) are repeated.

In practice, the instructions generally given to the lingerie fitting consultant is to first measure the midriff of the woman. Such measurement is usually carried out by placing a flexible tape measure about the midriff in a snug fashion immediately below the breasts of the woman. It is noted that the measurements reported in the discussion herein are in inches. After the measure of increment has been noted, four or five inches are added to the actual midriff measurement in order to determine the size of the band 18. For example, the actual midriff measurement of the woman is thirty-two inches. Therefore, the addition of four or five inches will give a midriff measurement of thirty-six or thirty-seven inches. With reference to Table 2, the band size which is suitable for the woman is size medium.

Then, in the determination of the cup size, the bust of the woman is measured using the same flexible tape measure. The following guidelines are applied in selecting a cup group:

(1) If the bust is four to five inches greater than the actual midriff measurement, cup group I which comprises cup sizes A, B and C is suitable.

(2) If the bust is six to seven inches greater than the actual midriff measurement, cup group II which comprises cup sizes B, C and D is suitable.

(3) If the bust is eight to nine inches greater than the actual midriff measurement, cup group III which comprises cup sizes C, D and DD is suitable.

(4) If the bust is ten to eleven inches greater than the actual midriff measurement, cup group IV which comprises cup sizes, D, DD and E is suitable.

(5) If the bust is twelve to fourteen inches greater than the actual midriff measurement, cup group V which comprises cup sizes E, F and G is suitable.

Turning back to the above example, the bust measurement of the woman is thirty-nine inches which is seven inches more than her actual midriff measurement of thirty-two inches. Thus, cup group II is appropriate for the woman. The brassiere sizing kit having first modules 20 with cup sizes B, C and D and second module 60 in size medium is selected. When assembling the first and second modules 20 and 60 respectively for fitment thereto, the woman is instructed to first attach the fastening means 32 of the first module 20 with the smallest cup size within the modular brassiere sizing kit, cup size B in this case, to the smallest band adjustment mechanism, fastening means 40, of the second module 60 with reference to FIG. 6. Cup sizes and band sizes are then increased until the most comfortably fitting modular brassiere fitment apparatus 10 is obtained.

By using the modular brassiere fitment apparatus 10, the woman is able to establish her brassiere size and thus the process of selecting brassieres is made easier. However, the modular brassiere fitment apparatus 10 is not limited to function only as a measuring apparatus. The woman may purchase a modular brassiere sizing kit which has several first modules 20 of the same size and several second modules 60 of the same size where each of the first module 20 has a mutually distinctive design or color, one from the other, or be transparent, and each of the second module 60 has a mutually distinctive design or color, one from the other, or be transparent. Thus, the woman may mix and match different first and second modules 20 and 60 respectively of the modular brassiere and wear the modular brassiere as an outer garment such as a bathing suit brassiere. Furthermore, if desired, she may incorporate the shoulder straps 46 to her modular brassiere to enhance the appearance of the brassiere.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed is:

1. A modular brassiere fitment apparatus comprising a pair of breast cups, a connecting front panel, two side panels, and a back panel;

said pair of breast cups, said connecting front panel, said two side panels and said back panel together being arranged so as to encircle the region of the midriff of the woman when said modular brassiere fitment apparatus is in use;

wherein said pair of breast cups, said connecting front panel and said two side panels comprise a first module;

wherein said back panel comprises a second module;

wherein each of said breast cups has front, bottom and side edges; wherein said front edge of each of said breast cups is connected to said connecting front panel such that each of said breast cups is adapted so as to be horizontally aligned below the respective breast for fitment thereto when said modular brassiere fitment apparatus is in use;

wherein each of said side panels has first and second ends; wherein said first end of each of said side panels is attached to said side edge of each of said respective breast cups such that each of said side panels is formed as a lateral extension of each of said respective breast cups; and wherein said second end of each of said side panels comprises fastening means for fitment of said modular brassiere fitment apparatus to the midriff of a woman;

wherein said back panel is symmetrical in structure and comprises first and second half back panels which are contiguous one with the other;

wherein said first half back panel has a first end; and wherein said second half back panel has a second end;

wherein said first and second ends of said back panel include said fastening means situated at said second end of each of said respective side panels so as to fasten said first and second ends of said back panel to said respective second end of each of said side panels such that said back panel and said two side panels are horizontally aligned at a fastening point and where each fastening point is adapted so as to be vertically aligned below the shoulder blade of the wearer when said modular brassiere fitment apparatus is in use;

wherein said back panel further comprises graduated indicia in at least one of said first and second ends of said respective first and second half back panels in the region of said fastening means so as to permit the midriff of the woman to be measured when said modular brassiere fitment apparatus is in use;

wherein each of said breast cups has defined shape and dimensions so as to receive and accommodate the respective breast of the woman when said modular brassiere fitment apparatus is in use; and wherein each of said breast cups is chosen from the group of breast cups consisting of a plurality of incremental breast cup sizes, within a predetermined range, so as to permit the breast of the woman to be fitted when said modular brassiere fitment apparatus is in use.

2. The modular brassiere fitment apparatus of claim 1, wherein each of said breast cups is chosen from the group consisting of molded cups, sewn cups and padded cups.

3. The modular brassiere fitment apparatus of claim 1, wherein each of said breast cups further comprises indicia so as to permit identification of the size of each of said breast cups.

4. The modular brassiere fitment apparatus of claim 1, wherein each pair of breast cups is chosen from the group consisting of two breast cups of equal size, two breast cups of unequal size, and one breast cup and one prosthesis.

5. The modular brassiere fitment apparatus of claim 1, wherein said second end of each of said side panels is fastened to said respective first and second ends of said back panel by a two-part fastener chosen from the group of two-part fasteners consisting of hook and eyelet fasteners, hook and loop fasteners, and snap and dome fasteners.

6. The modular brassiere fitment apparatus of claim 5, wherein said two-part fastener has first and second elements so as to fasten said second end of each of said side panels to said respective first and second ends of said back panel.

7. The modular brassiere fitment apparatus of claim 6; wherein said first element of said two-part fastener is situated at said second end of each of said side panels; and wherein said first element of said two-part fastener comprises a single row of fastener means in vertical alignment.

8. The modular brassiere fitment apparatus of claim 6, wherein said second element of said two-part fastener is situated at each of said first and second ends of said back panel; wherein said second element of said two-part fastener comprises a plurality of fastening means in vertical alignment.

9. The modular brassiere fitment apparatus of claim 6, wherein said second end of each of said side panels overlies a substantial portion of said respective first and second ends of said back panel when said second end of each of said side panels is fastened to said respective first and second ends of said back panel.

10. The modular brassiere fitment apparatus of claim 1, further comprising a pair of shoulder straps, and wherein said pair of shoulder straps comprises a third module.

11. The modular brassiere fitment apparatus of claim 10, wherein each of said shoulder straps further comprises an adjustable buckle so as to permit longitudinal adjustment of each of said shoulder straps.

12. The modular brassiere fitment apparatus of claim 10, wherein each of said shoulder straps connects between a respective one of said breast cups and a respective one of said half back panels such that each of said shoulder straps extends upwardly over the shoulder of the woman and downwardly over the back of the woman when said modular brassiere fitment apparatus is in use.

13. The modular brassiere fitment apparatus of claim 12, wherein each of said shoulder straps is permanently affixed to one of said half back panels.

14. The modular brassiere fitment apparatus of claim 12, whereine each of said shoulder straps is connected to one of said halfback panels and wherein the connection between each of said shoulder straps and one of said half back panels comprises a hoop and loop structure.

15. The modular brassiere fitment apparatus of claim 12, wherein each of said shoulder straps is permanently affixed to a respective one of said breast cups.

16. The modular brassiere fitment apparatus of claim 12, wherein each of said shoulder straps is connected to a respective one of said breast cups, and wherein the connection between each of said shoulder straps and one of said breast cups comprises a hoop and loop structure.

17. The modular brassiere apparatus of claim 1, wherein said connecting front panel, said two side panels, said back panel and said pair of shoulder straps are all formed from pliant materials so as to provide comfort to the woman of said modular brassiere fitment apparatus.

18. The modular brassiere fitment apparatus of claim 1, wherein each of said breast cups further comprises an underwire at said bottom edge of each of said breast cups so as to provide uplift support to each breast of the woman when said modular brassiere fitment apparatus is in use.

19. A modular brassiere sizing kit comprising at least two first modules and at least two second modules;

wherein each of said at least two first modules comprises a pair of breast cups, a connecting front panel and two side panels;

wherein each of said at least two second modules comprises a back panel;

wherein each of said first modules has a different size one from the other; and wherein each of said second modules has a different size one from the other;

whereby, when one of said at least two first modules is assembled to one of said at least two second modules, the combination of said first and second module constitutes a modular brassiere fitment apparatus according to claim 1.

20. The modular brassiere sizing kit of claim 19, wherein each of said at least two first modules of said modular brassiere fitment apparatus further comprises indicia so as to permit identification of the size of each respective one of said at least two first modules.

21. The modular brassiere sizing kit of claim 19, wherein each said pair of breast cups of said modular brassiere fitment apparatus has a mutually distinctive color, one from the other.

22. The modular brassiere sizing kit of claim 19, wherein each of said at least two second modules of said modular brassiere fitment apparatus further comprises indicia so as to permit identification of the size of each respective one of said at least two second modules.

23. The modular brassiere sizing kit of claim 19, further comprising at least one pair of shoulder straps, wherein said pair of shoulder straps comprises a third module of said modular brassiere fitment apparatus.

24. A method of determining the brassiere size of any woman using a modular brassiere sizing kit;

said modular brassiere sizing kit comprising at least two first modules and at least two second modules;

wherein each of said at least two first modules comprises a pair of breast cups, a connecting front panel and two side panels;

wherein each of said at least two second modules comprises a back panel;

wherein each of said first modules has a different size one from the other; and wherein each of said second modules has a different size one from the other;

whereby, when one of said at least two first modules is assembled to one of said at least two second modules, the combination of said first and second module constitutes a modular brassiere fitment apparatus;

said method comprising the steps of:

(a) selecting one of said at least two first modules of an apparent appropriate size from said modular brassiere sizing kit;

(b) selecting one of said at least two second modules of an apparent appropriate size from said modular brassiere sizing kit;

(c) fastening a second end of one of said side panels of said first module to a respective end of said back panel of said second module;

(d) fitting said modular brassiere fitment apparatus to a woman;

(e) completing the assembly of said modular brassiere fitment apparatus by fastening the second end of said other side panel of said first module to the respective end of said back panel of said second module;

(f) adjusting said modular brassiere fitment apparatus such that said modular brassiere fitment apparatus encircles the region of the midriff of the woman;

(g) adjusting said modular brassiere fitment apparatus such that each of said breast cups of said first module is horizontally aligned below the respective breast of the woman for fitment thereto.

25. The method of claim 24, wherein when said at least one of said first and second modules of said modular brassiere fitment apparatus is incorrect in size, steps (a) through (g) are repeated.

* * * * *